US005447269A

United States Patent [19]

Fultz

[11] Patent Number: 5,447,269

[45] Date of Patent: Sep. 5, 1995

[54] MULTIPLE UNIT BOX AND BLANK THEREFOR

[75] Inventor: Jerry Fultz, Lancaster, Pa.

[73] Assignee: BC-USA, Inc., New Holland, Pa.

[21] Appl. No.: 234,370

[22] Filed: Apr. 28, 1994

[51] Int. Cl.[6] ..... B65D 25/04

[52] U.S. Cl. ..... 229/120.21; 229/162

[58] Field of Search ..... 229/112, 113, 162, 120.21, 229/120.18, 120.32

[56] References Cited

U.S. PATENT DOCUMENTS

| | | | |
|---|---|---|---|
| 2,345,646 | 4/1944 | Williamson | 229/113 |
| 3,309,005 | 3/1967 | Pilger | 229/112 X |
| 3,860,305 | 1/1975 | Bergman | 229/162 X |
| 4,274,578 | 6/1981 | Montealegre | 229/120.21 X |
| 4,925,087 | 5/1990 | Ostrander | 229/162 X |
| 5,076,492 | 12/1991 | Tupes | 229/120.21 |
| 5,264,996 | 11/1993 | Bele, Jr. et al. | 229/113 X |

FOREIGN PATENT DOCUMENTS

| | | | |
|---|---|---|---|
| 1666379 | 7/1991 | U.S.S.R. | 229/112 |

*Primary Examiner*—Allan N. Shoap
*Assistant Examiner*—Christopher J. McDonald
*Attorney, Agent, or Firm*—Vickers, Daniels & Young

[57] ABSTRACT

A box for storing at least two individually packaged food products including a horizontal separator panel for separating the products and contributing to the strength of the subject box. The box also includes angled upper side walls to increase its rigidity.

18 Claims, 7 Drawing Sheets

MULTIPLE UNIT BOX AND BLANK THEREFOR

The present invention is directed toward a paperboard box, more specifically to a paperboard box adapted to hold and separate at least two prepackaged food products.

BACKGROUND OF THE INVENTION

It is often necessary to provide a cardboard or paperboard box for packaging food items, even when said food items are already hermetically sealed in smaller packages. This is especially true when the individually wrapped food items are relatively small. By packing such items in a paperboard box, the items can be more easily handled, a reasonable number can be sold together at one price, and a larger surface area can be provided for displaying product information. Additionally, when the individual packages are of an irregular shape, a box can provide a form that is easy to stack, transport and store.

Such boxes must be sufficiently strong to retain several items and be stacked for storage and shipment. Environmental and economic concerns, however, require that a minimum of packaging material be used. Known boxes are often made of reactively thick cardboard or paperboard and may include separate dividers and supports to further increase the strength and rigidity of the box. When the items within the box do not substantially fill the box and thus contribute to the rigidity of the box, extra supports are also needed. Use of such constructions adds to the cost of the box, increases the difficulty of assembling the box and packing a product therein, and results in a relatively large amount of packaging waste to be disposed of.

It can be desirable to package products in boxes which allow the products therein to be viewed. This is done by providing openings in the box which may be covered by a thin sheet of transparent material. When the products are larger than the openings and are hermetically sealed in individual containers, the openings need not be covered with a transparent material. However, removing parts of a box to provide viewing openings therein weakens the box thereby requiring that thicker material or additional strengthening panels be used in the box interior.

Finally, it is well known to form boxes from flat cardboard blanks which can then be glued and folded to produce a desired box. Known boxes can require many separate gluing and folding steps in order to produce a box. If separator panels or strengthening panels are used, the additional steps of providing these panels and fitting or gluing them into a box become necessary. This tends to increase the cost and decrease the efficiency of the packing process.

SUMMARY OF THE INVENTION

The present invention overcomes the above-referenced problems and others, and provides a paperboard box for holding food items which is of superior strength and rigidity and which is manufactured by an improved method.

In accordance with a principal feature of the invention, a box is provided with a separator panel formed integrally with at least one wall of the box for maintaining at least two food items in a desired orientation. This separator can be located in a manner such that a first item can be readily inserted into the box, after which the separator can be easily folded down over and around the food item to provide a platform for supporting a second item. Furthermore, the separator panel, part of which is disposed in a plane parallel to the bottom of the box, gives interior support to the box and allows a thinner paperboard material to be used. The separator panel is in contact with or in close proximity to each of the four side walls and therefore tends to prevent the side walls from being forced into the box interior. This arrangement strengthens the box and provides added protection for the food products therein from lateral forces applied to the box. Forming the panel integrally with one wall of the box eliminates the need for assembling a separate panel to separate the items. The integral construction increases the amount of support provided by the panel by ensuring that the panel remains in its proper orientation.

In accordance with a further feature of the invention, the separate panel includes a vertical support leg which is attached to a side wall of the box along a vertical seam. This construction contributes to the strength of the separator panel as a portion of the weight of the product resting on the support panel is borne by a side panel. The separator panel will not deform until stress is applied sufficient to tear the separator away from the side wall along the vertical seam.

In accordance with another feature of the invention, the subject box includes upper portions of the sides of the box which are angled in toward the interior of the box. This further contributes to the strength of the box by increasing the lateral and the torsional rigidity of the box and also helps to maintain the separator panel in its intended orientation.

In accordance with yet another feature of the invention, a box is provided with openings which allow the product to be viewed. This unique box design allows the provision of relatively large openings without compromising the strength of the box or requiring the use of additional supporting members therein. By leaving such openings uncovered, air can be easily circulated around the individual containers to keep the products at a required temperature.

In accordance with a further feature of the invention, the angled upper portions of the side walls not only contribute to the rigidity of the box but also provide an information-bearing surface which can be viewed when the box is displayed on a relatively low shelf, as well as when the box is displayed at eye-level.

In accordance with another feature of the present invention, a box is provided having an integral, interior separator panel which box can be formed from a unitary blank of paperboard material. Furthermore, the subject blank is designed so that after all of the necessary gluing is done, the box may be stored in a flat configuration as a proto-box. After the glue has dried, the box may be formed by manipulating the blank without any additional gluing. Thus, the boxes may be shipped and stored in a flat configuration and readily assembled, filled, and closed as required.

It is, therefore, the principal object of the subject invention to provide a strong paperboard box manufactured from a paperboard material and suitable for storing individually wrapped food products.

It is another object of the subject invention to provide a paperboard box for storing at least two prepackaged food items having a panel for separating the food items which is formed integrally with a wall of the box.

It is a further object of the subject invention to provide a paperboard box having angled side wall portions to increase the strength and rigidity of the box.

It is yet another object of the subject invention to provide a paperboard box having openings therein for viewing the product therein.

It is still another object of the present invention to provide a paperboard box which can be assembled from a unitary blank of paperboard.

It is yet a further object of the present invention to provide a unitary blank which can be folded and glued to form a paperboard box having a panel for separating items within the box.

It is still a further object of the present invention to provide a unitary blank which can be folded and glued in order to form a proto-box which can then be manipulated into a final box configuration.

It is another object of the present invention to provide a paperboard box having surfaces which can be readily viewed from floor level or eye level.

BRIEF DESCRIPTION OF THE DRAWINGS

These and other objects of the invention will become apparent from the following detailed description of a preferred embodiment thereof shown in the accompanying drawings in which.

PREFERRED EMBODIMENT

Figure 1:
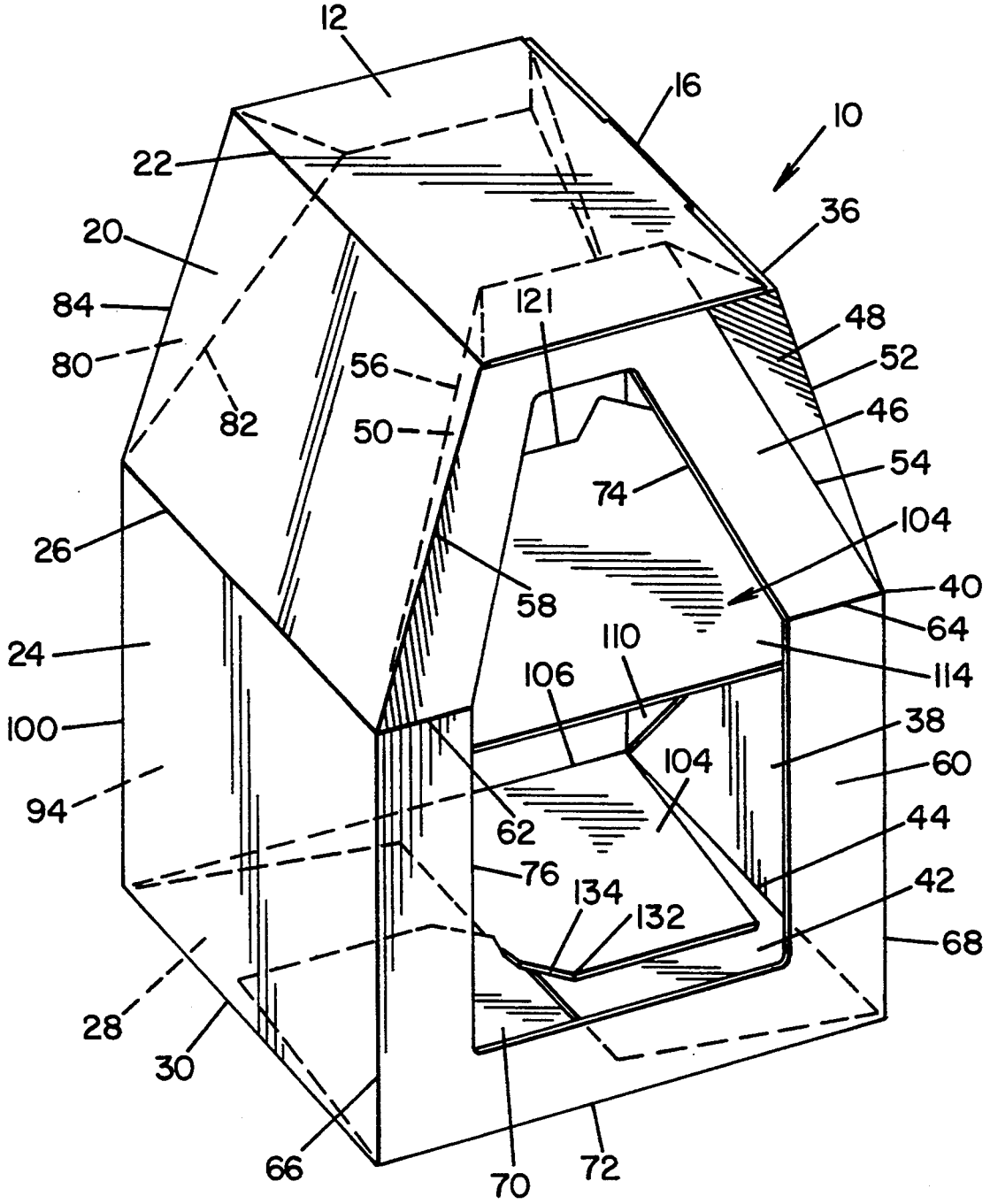
FIG. 1 is a front perspective view of a box according to the present invention.
Figure 2:
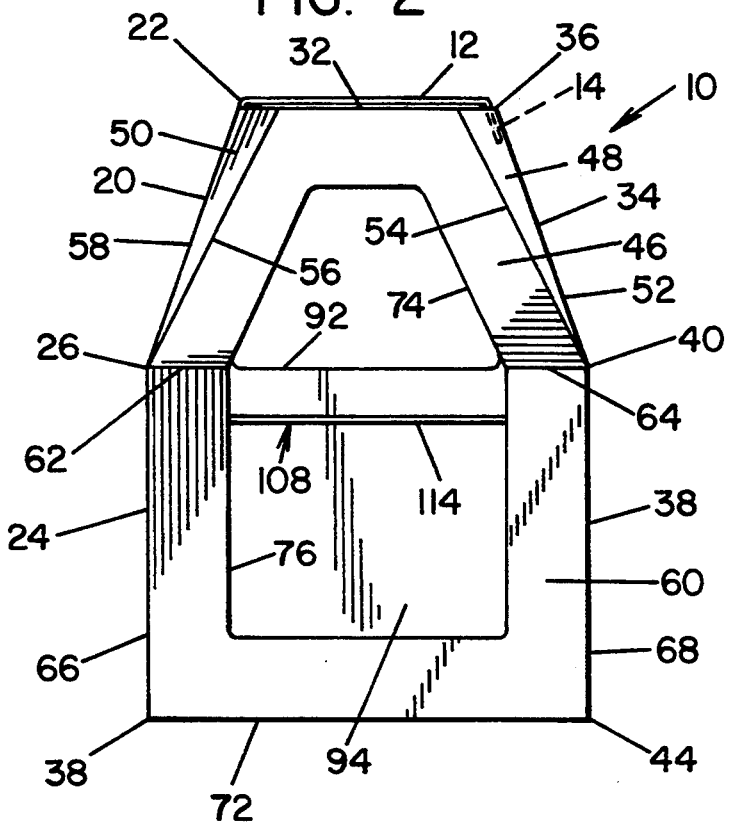
FIG. 2 is a side elevation view of the box looking in the direction from right to left in FIG. 1.
Figure 3:
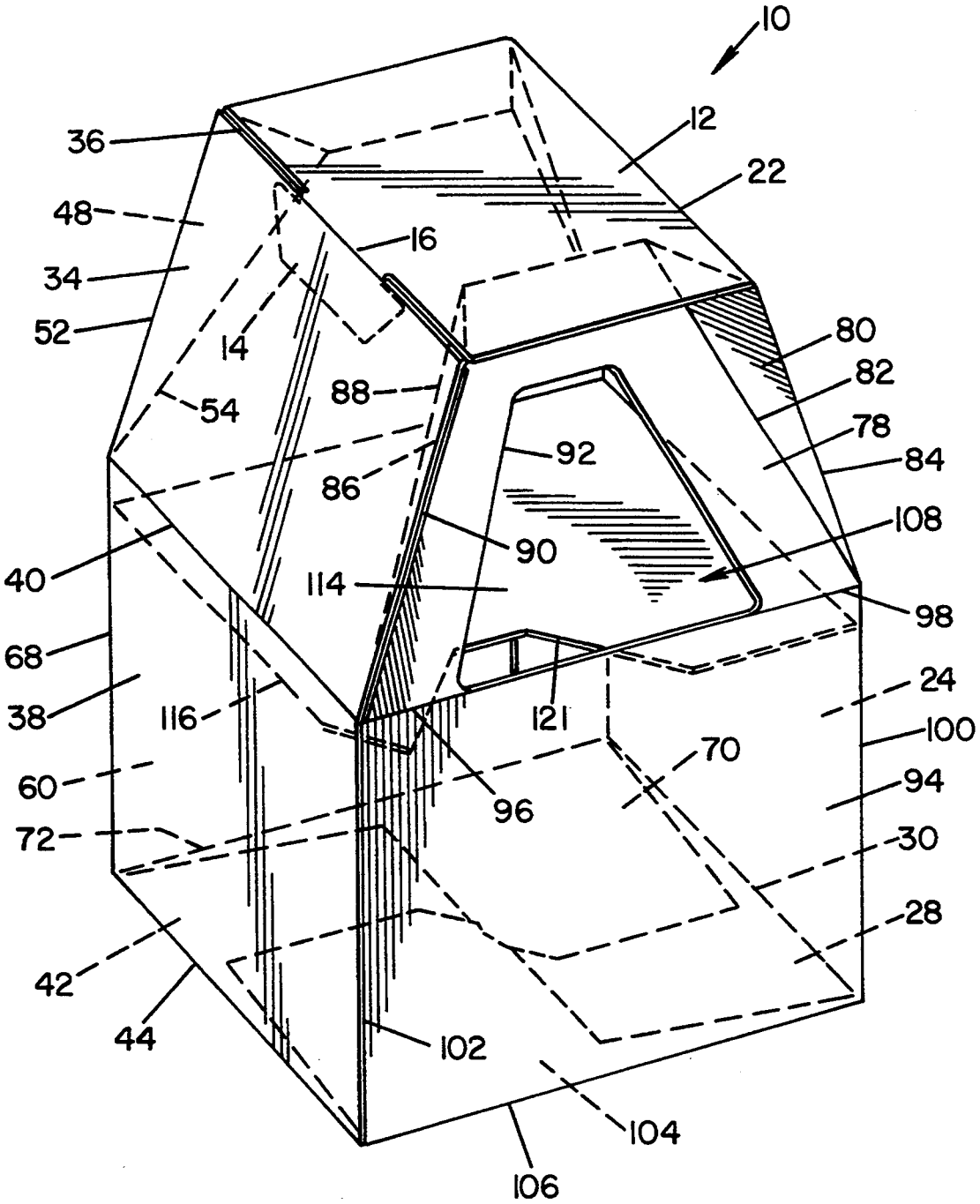
FIG. 3 is a rear perspective view of the box shown in FIG. 1.
Figure 5:
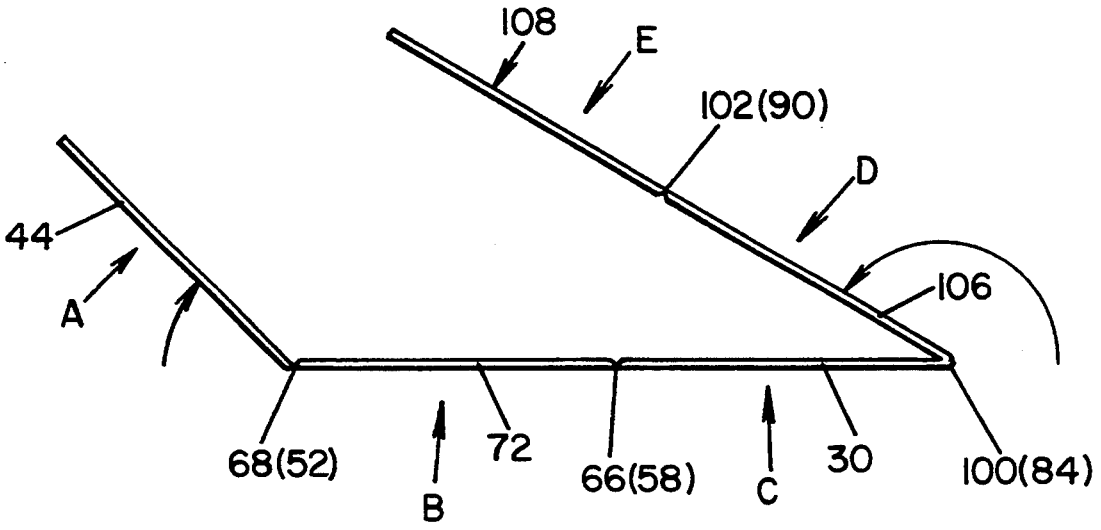
FIG. 5 is a view of the paperboard blank in FIG. 4 partially folded to form the proto-box according to the present invention.
Figure 6:
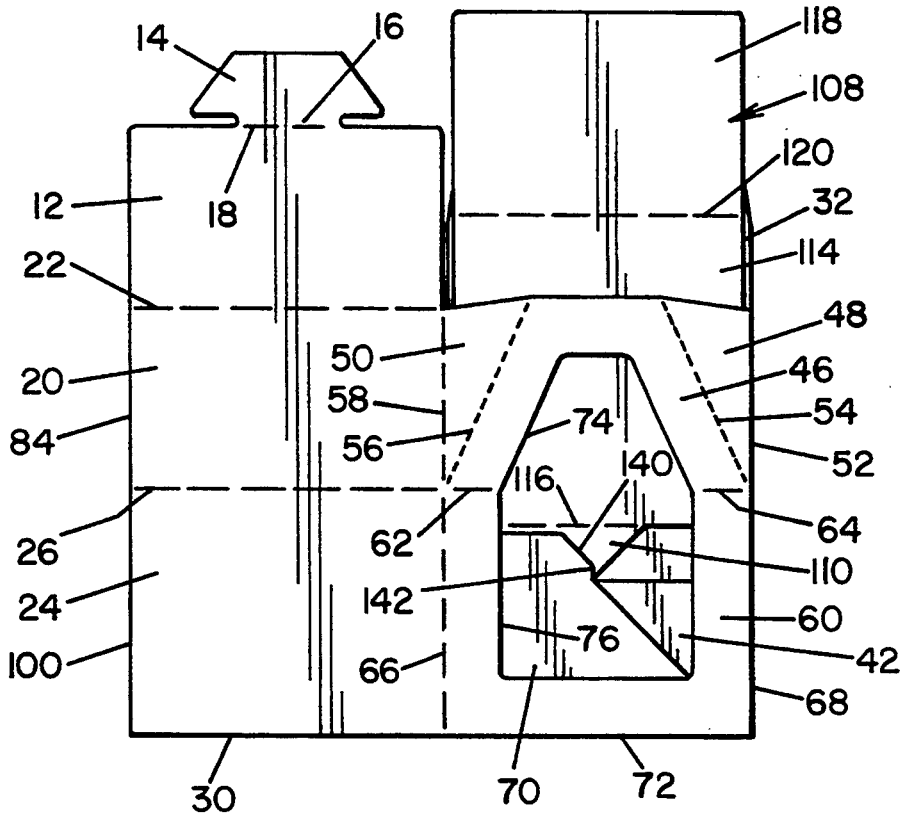
FIG. 6 is a plan view of one side of the paperboard blank in FIG. 4 folded to provide the proto-box according to the present invention.
Figure 7:
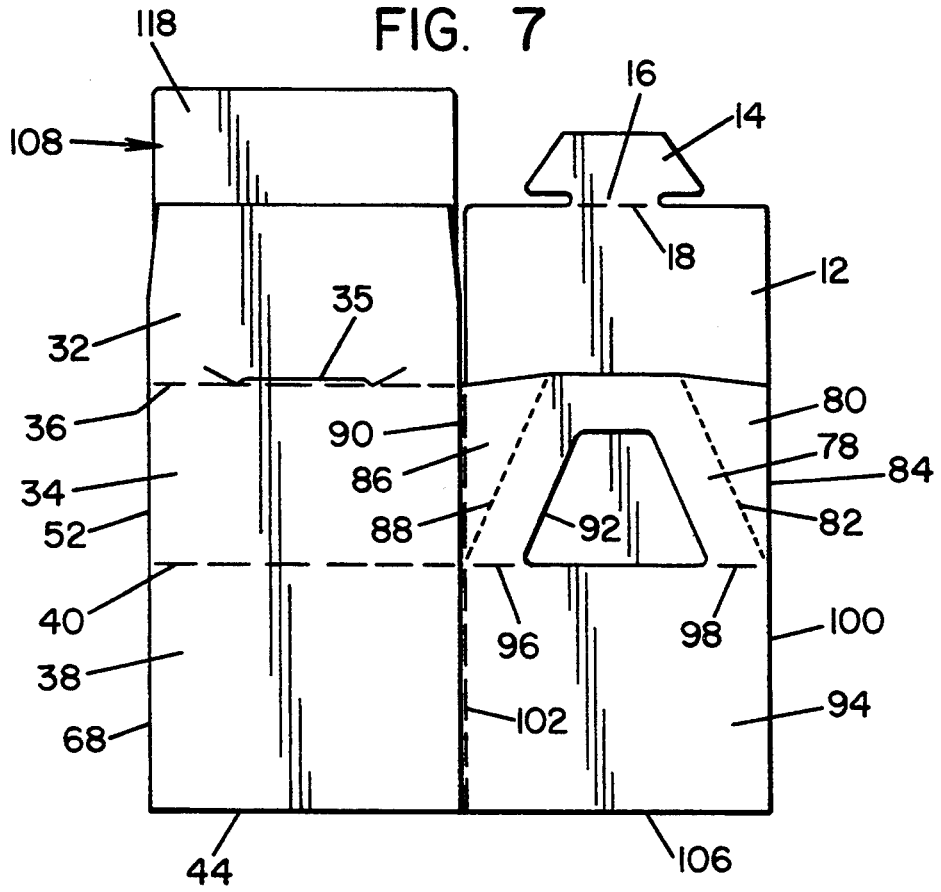
FIG. 7 is a plan view of the other side of the proto-box shown in FIG. 6.
Figure 9:
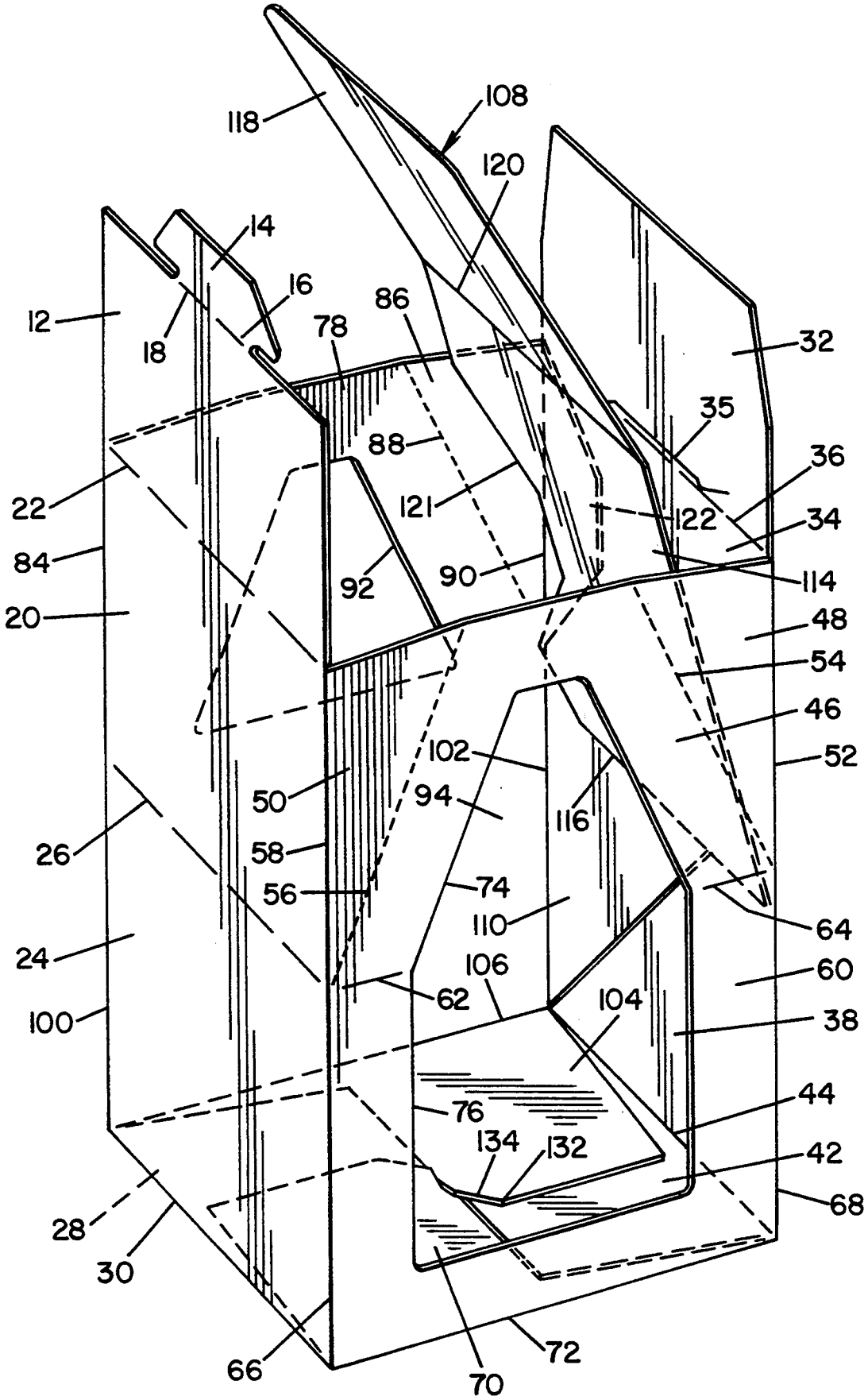
FIG. 9 is a perspective view of the box shown in FIG. 1 partially erected for receiving a first food item.

Referring now to the drawings where the showings are for the purpose of illustrating the preferred embodiment of the invention only and not for purposes of limiting same, in FIGS. 1–3 there is shown a box in its erected form, designated generally by the number 10. Box 10 is constructed from a paperboard blank 11 shown in FIG. 4 and which, as described in detail hereinafter, is adapted to be folded and to have certain panels thereof glued together to provide a collapsed proto-box form for the box, as shown in FIGS. 6 and 7. As will be appreciated from FIGS. 1–4, together with FIGS. 5, 6 and 7 which show the proto-box in various stages of construction, box 10 comprises an outer top panel 12 including a tab 14 attached to outer top panel 12 by tab neck 16 at fold line 18, an upper front wall panel 20 connected to outer top panel 12 at fold line 22, a lower front panel 24 connected to upper front panel 20 at fold line 26 and a first bottom wall panel 28 connected to lower front panel 24 at fold line 30. Box 10 further comprises an inner top panel 32 connected to an upper back panel 34 at fold line 36, a lower back panel 38 connected to upper back panel 34 at fold line 40, and a second bottom panel 42 connected to lower back panel 38 at fold line 44. A slot 35 along fold line 36 receives tab 14 to retain the box in its erected form. Upper front panel 20 is connected to upper back panel 34 by a first upper side panel 46 including a first soffit 48 and a second soffit 50. As best seen in FIGS. 2 and 9, upper back panel 34 is attached to side panel 46 and first soffit 48 at fold line 52, and first soffit 48 is defined by perforated fold line 54 in first upper side panel 46. Similarly, upper side panel 46 is connected to front panel 20 at fold line 58 and second soffit 50 is defined by perforated fold line 56, in side panel 46. First upper side panel 46 is attached to a first lower side panel 60 at fold lines 62 and 64. First lower side panel 60 is in turn connected to lower front panel 24 at fold line 66, to lower back panel 38 at fold line 68, and to a third bottom panel 70 at fold line 72. Panel 70 is provided with a perforated fold line 71 providing a glue flap portion 73 for the purpose set forth hereinafter. Further, panel 70 includes an edge 140 and a notch 142, the purposes of which will be described in connection with the erection of box 10. First upper side panel 46 includes an opening 74 which is continuous with an opening 76 in first lower side panel 60. As will be seen in FIGS. 2, 3, 7 and 9, box 10 also includes a second upper side panel 78 substantially identical to first upper side panel 46. In this respect, second upper side panel 78 includes a first soffit 80 defined by perforated fold line 82 therein, and the panel is connected to upper front panel 20 at fold line 84. Upper side panel 78 also includes a second soffit 86 defined by perforated fold line 88, and is connected to upper back panel 34 at fold line 90. Upper side panel 78 also includes an opening 92. A second lower side panel 94 is attached to upper side panel 78 at fold line 96 and fold line 98, to lower front panel 24 at fold line 100, to lower back panel 38 at fold line 102 and to a fourth bottom panel 104 at fold line 106. Panel 104 is provided with a perforated fold line 105 which provides a glue panel portion 107 for the purpose set forth hereinafter. Further, panel 104 includes an edge 134, a corner 132 and a notch 136 which notch is adapted to engage notch 142 during the erection of the box.

An interior divider 108 is located in the interior of the box 10 and comprises a vertical support panel 110 attached to side wall 94 at fold line 102, a horizontal separator panel 114 attached to panel 110 at fold line 116, and a vertical support panel 118 attached to panel 114 at fold line 120. A cut line 121 in panel 114 provides a glue flap 122 for the purpose set forth hereinafter.

Figure 4:
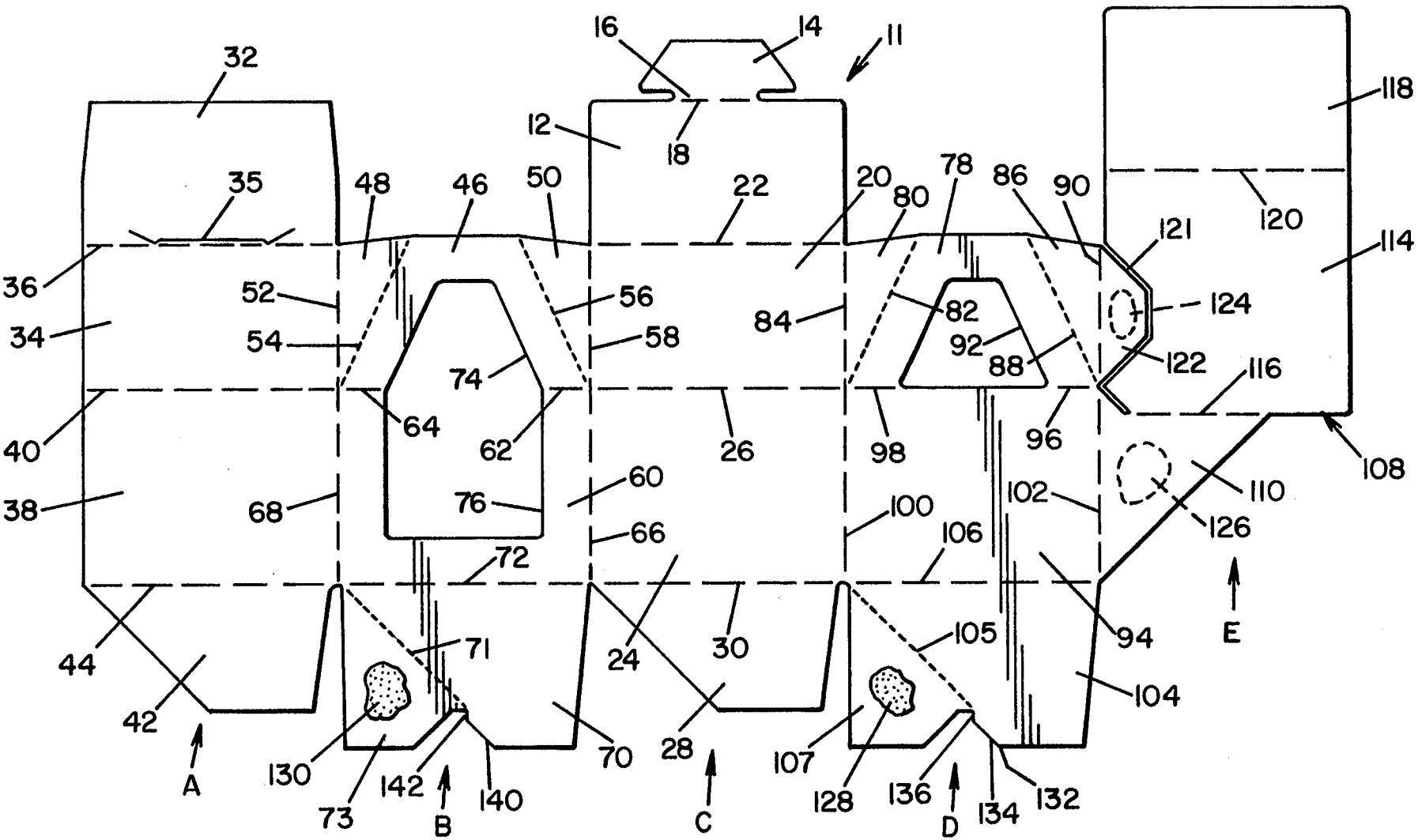
FIG. 4 is a plan view of a paperboard blank according to the present invention and from which the proto-box is constructed.

Referring now to FIG. 4, the forming of the proto-box from paperboard blank 11 will be described. The panels and fold lines on the paperboard blank bear the same numerals as the panels of the finished box as described above. For purposes of describing the assembly of the proto-box, the vertical strip of panels 32, 34, 38 and 42 is designated generally by the letter A, the vertical strip of panels consisting of panel 46, 60 and 70 is designated generally by the letter B, the vertical strip of panels consisting of panel 12, 20, 24 and 28 is designated generally by the letter C, the vertical strip of panels consisting of panel 78, 94 and 104, is designated by the letter D, and the vertical strip of panels consisting of panel 118, 114 and 110 is designated generally by the letter E as shown in FIG. 4.

The proto-box is constructed from the paperboard blank shown in FIG. 4 as follows: with respect to the flat orientation shown in FIG. 4, bottom panel 42 is folded upwardly about fold line 44 so that it overlies panel 38, bottom panel 70 is folded upwardly about fold line 72 so that it overlies panel 60, bottom panel 28 is folded upwardly about fold line 30 so that it overlies panel 24, and bottom panel 104 is folded upwardly about fold line 106 so that it overlies panel 94. Next, glue flap 73 on bottom panel 70 is folded outwardly about fold line 71 toward fold line 72 so that flap 73 overlies the outer side of bottom panel 70, and glue flap 107 is folded outwardly about fold line 105 toward fold line 106 so that it overlies the outer side of bottom panel 104. Dabs of glue are next applied to area 124 on the under side of glue flap 122, to area 126 on the under side of support panel 110, to location 128 on the upper side of glue flap 107 and to location 130 on the upper side of glue flap 73. As shown in FIG. 5, panel strips D and E are then folded upwardly and counterclockwise about fold lines 84 and 100 so that panel strip D overlies panel strip C and panel strip E overlies panel strip B. In this position, the glue at location 128 contacts bottom panel 28 which overlies panel 24, the glue at location 124 on glue tab 122 is located in proximity to fold line 58 and faces upwardly and the glue in area 126 on the support panel 110 is located in proximity to fold line 66 and faces upwardly. Also at this time, panel 114 overlays panel 46 and a portion of panel 60 below fold line 62, support panel 110 overlies bottom wall panel 70 which in turn overlies panel 60, and the glue in area 130 of glue flap 73 faces upwardly. Panel strip A is then folded upwardly and clockwise about fold lines 52 and 68 as shown in FIG. 5, onto panel strip E which in turn overlays a portion of panel strip B in this configuration. In this position, bottom panel 42 contacts the glue at location 130 on glue flap 73, panel 38 contacts the glue at location 126 on support panel 110, and panel 34 contacts the glue at location 124 on glue flap 122. The folded blank is then allowed to dry in this configuration which is the proto-box shown in FIGS. 6 and 7. After the glue is dry, the collapsed box or proto-box may be shipped and stored in this configuration until ready for use. As will be appreciated from the foregoing description, when the box is in the collapsed configuration bottom wall panels 28 and 104 are fastened together by the glue in area 128 of foldable glue flap 107, and bottom wall panels 42 and 70 are fastened together by the glue in the area 130 of foldable glue flap 73. Furthermore, the glue in area 126 of support panel 110 interconnects wall panels 94 and 38 and positions divider panel 114 and support panel 118 in overlying relationship with panels 34 and 32, and the glue in area 124 of glue tab 122 connects wall panels 78 and 34.

Figure 8:
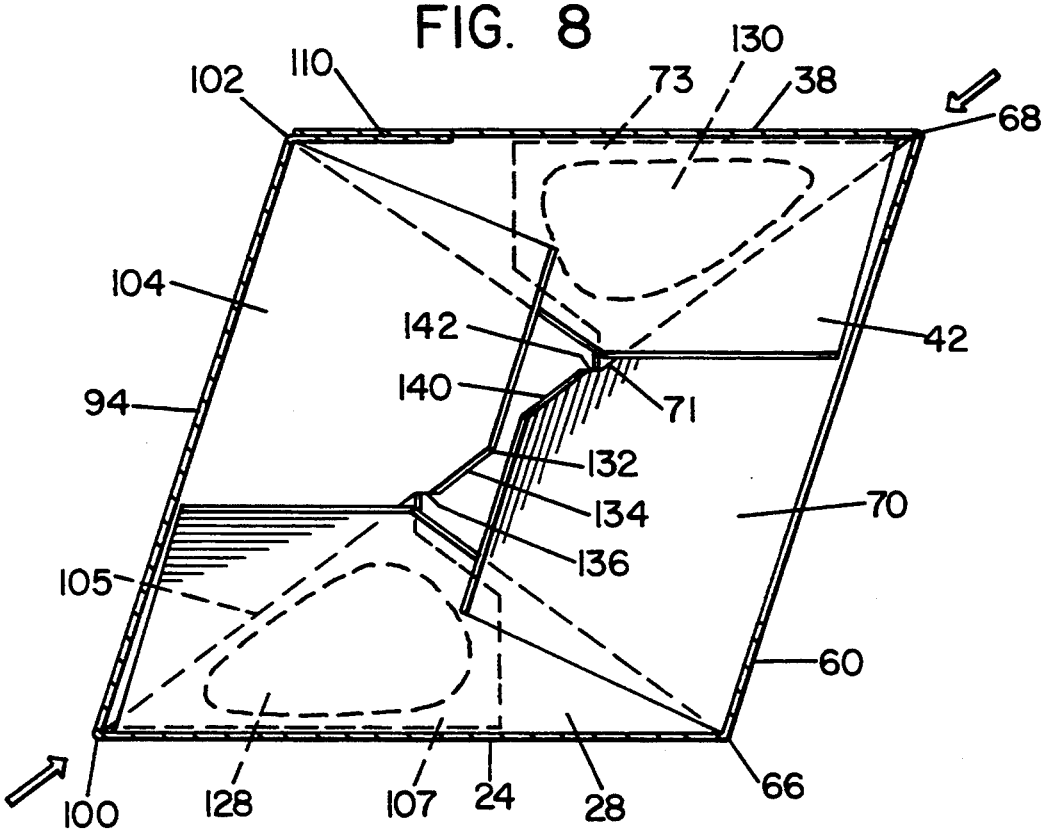
FIG. 8 is a plan view of the interior bottom of the box showing the relative positions of the bottom flaps of the box shown in FIG. 1 during the erection of the box.

To erect the box from the collapsed configuration shown in FIGS. 6 and 7, pressure is applied laterally inwardly at fold lines 100 and 68 until wall 38 is generally parallel to Wall 24 and wall 60 is generally parallel to wall 94 as shown in FIGS. 8 and 9. As fold line 100 is pushed toward fold line 68, bottom wall panels 28, 42, 70 and 104 pivot downwardly about their corresponding fold lines 30, 44, 72 and 106 and perforated fold lines 71 and 105 toward a co-planar relationship and, during such pivotal movement, slidably interengage to interlock the panels to provide the bottom wall for the box. More particularly in this respect, as will be appreciated from FIG. 8, corner 132 of bottom wall panel 104 comes in contact with bottom wall panel 70 and slides across edge 140 of panel 70. Next, edge 134 of panel 104 comes in contact with edge 140 of panel 70 and, as fold lines 100 and 68 are pushed further together, bottom wall panels 42, 70, 28 and 104 become more nearly co-planar and perpendicular to the side panels of the box. As edge 140 slides over edge 134, notch 136 on panel 104 engages notch 142 on panel 70 thereby locking all four bottom panels together in an orientation perpendicular to the walls of said box. The partially erected box at this point is shown in FIG. 9. A first item (not shown) is then placed in the box interior so that it rests on bottom panels 42, 70, 78 and 104. Next, support panel 118 is folded at fold line 120 and separator panel 114 is folded into the interior of the box at fold line 116 to extend over the first food item. Support panel 118 extends parallel to and in contact with wall 24, and engages the bottom of the box to position separator panel 114 parallel to bottom panels 42, 70, 28 and 104 as seen in FIGS. 1 and 2. A second item is now placed on top of support panel 114, after which panels 46 and 78 are pushed toward one another which, through perforated fold lines 54, 56 82 and 88 and fold lines 52, 58, 84 and 90 pulls panels 20 and 34 toward one another, whereby panels 20, 34, 46 and 78 incline inwardly as shown in FIG. 1–3. Inner top panel 32 is then folded about fold line 36 so that it is parallel to horizontal separator panel 114, and outer top panel 12 is folded about fold line 22 to extend over inner top panel 32. Tab 14 is folded at fold line 18 and inserted into slot 35 located along fold line 36 to releasable lock the box closed.

In the preferred embodiment, upper front panel 20 is angled inwardly over bottom panel 28 and upper back panel 34 is angled inwardly over bottom panel 42 as best seen in FIG. 1. Furthermore, upper side panel 46 is angled inwardly over bottom panel 70 and upper side panel 78 is angled inwardly over bottom panel 104. Side panels 46, 78 are angled inwardly at a greater angle than front panel 20 and back panel 34 so that panels 46, 78 extend beneath outer top panel 12 and inner top panel 32. Upper side panel 46 is connected to upper back panel 34 by soffit 48 and to upper front panel 20 by soffit 50. Upper side panel 78 is connected to upper front panel 20 by soffit 80 and to upper rear panel 34 by soffit 86 and glue tab 122. The relationship of the angle at which the upper side panels are angled and the angle at which the upper front and back panels are angled is such that soffits 48, 86 are not parallel to upper back panel 34 and soffits 50, 80 are not parallel to upper front panel 20. Soffits 48 and 86 therefore do not lay flush against upper back panel 34 and soffits 50 and 80 do not lay flush against upper front panel 20. While other angular relations could be used, the preferred configuration contributes to the vertical stability of the subject box.

The invention has been described with reference to the preferred embodiment. Obviously, modifications and alterations will occur to others upon the reading and understanding of this specification. It is intended to include all such modifications insofar as they come within the scope of the appended claims or the equivalents thereof.

Having thus described the invention, it is claimed:

1. A box for storing and maintaining a separation between at least two individual products, said box comprising:

a bottom wall formed from four bottom panels, two of said bottom panels being interlocking;

four side walls each comprising a lower side wall panel perpendicular to said bottom wall and a corresponding upper side wall panel angled inwardly over said bottom wall;

a top wall parallel to said bottom wall and extending from one of said upper side wall panels; and a separator panel attached to one of said side wall panels for pivotal movement relative to said bottom wall, and said separator panel being adapted to support at least one of said at least two food items.

2. A box according to claim 1, wherein each of said bottom panels of said bottom wall is integrally connected to one of said lower side wall panels.

3. A box according to claim 2, wherein at least one of said upper side wall panels includes an opening therein.

4. A box according to claim 3, wherein at least one of said lower side wall panels includes an opening therein.

5. A box according to claim 2, wherein two of said upper side wall panels include openings therein, and one of said lower side wall panels includes an opening therein continuous with the opening in one of said upper side wall panels.

6. A box according to claim 1, wherein two of said upper side wall panels are planar and two of said upper side wall panels include a central panel and two soffit portions defined by perforated fold lines, each said soffit portion extending between the corresponding central panel and a different one of said planar upper side wall panels.

7. A box according to claim 6, wherein each of said central panels includes an opening therein, each of said central panels is angled over said bottom wall at an angle greater than the angle at which said planar upper side wall panels are angled such that each of said central panels meets the corresponding soffit portions at an oblique angle.

8. A box according to claim 7, wherein said top wall includes tab means received in a slot for maintaining the relative orientations of said panels.

9. A box according to claim 6, wherein said separator panel comprises a first vertical support panel portion attached to said one of said lower side wall panels, a horizontal panel portion integrally attached to said first vertical support panel, and a second vertical support panel portion integrally attached to said horizontal panel portion.

10. A box according to claim 9, wherein said first vertical support panel portion is adhesively attached to said one of said lower side wall panels and is integrally attached to a lower side wall panel adjacent to said one of said lower side wall panels along a vertical fold line.

11. A box according to claim 1, wherein said separator panel joins said one of said lower side wall panels at a fold-line perpendicular to said bottom wall.

12. A box according to claim 11, wherein said separator panel is pivotal relative to said one lower side panel about a fold line parallel to said bottom wall.

13. A paperboard blank adapted to be folded to form a box for containing at least two items, said blank having spaced apart opposite ends and spaced apart top and bottom ends and comprising first, second, third, fourth and fifth panel sections integrally joined sequentially between said opposite ends along first parallel fold lines therebetween, each of said panel sections having a plurality of sub-panels integrally joined along second parallel fold lines transverse to said first fold lines;

said first panel section comprising, sequentially in the direction from said top to said bottom end, an inner top sub-panel, a first upper side sub-panel, a first lower side sub-panel and a first bottom sub-panel;

said second panel section comprising, sequentially in the direction from said top to said bottom end, a second upper side sub-panel adjacent to said first upper side sub-panel, a second lower side sub-panel adjacent to said first lower side sub-panel and a second bottom sub-panel having a glue flap and a notch;

said third panel section comprising sequentially in the direction from said top to said bottom end, a tab, an outer top sub-panel, a third upper side sub-panel adjacent said second upper side sub-panel, a third lower side sub-panel adjacent said second lower side sub-panel and a third bottom sub-panel;

said fourth panel section comprising sequentially in the direction from said top to said bottom end, a fourth upper side sub-panel adjacent said third upper side sub-panel said fourth upper side sub-panel including a glue tab, fourth lower side sub-panel adjacent said third lower side sub-panel and a fourth bottom sub-panel having a glue flap and a notch; and, said fifth panel section comprising a separator panel comprising sequentially in the direction from said top to said bottom end, a vertical support wall, a horizontal separator wall attached to said vertical support wall and including a glue tab attached to said fourth upper side sub-panel, and a connector sub-panel connected to said horizontal separator wall and to said fourth lower side sub-panel.

14. A paperboard blank according to claim 13, folded to form a flat proto-box wherein said glue flap on said fourth bottom sub-panel is glued to said third bottom sub-panel, said glue flap of said second bottom sub-panel is glued to said first bottom sub-panel, said glue tab of said fourth upper side sub-panel is glued to said first upper side sub-panel, said connector sub-panel of said fifth panel is glued to said first lower side sub-panel, and said notch on said second bottom sub-panel is engaged with said notch on said fourth bottom sub-panel.

15. A paperboard blank adapted to be folded to form a box for containing at least two items said box having spaced apart opposite ends and spaced apart top and bottom ends, said blank comprising first, second, third, fourth and fifth panel sections integrally joined sequentially between said opposite ends along first parallel fold lines therebetween, each of said panel sections having a plurality of sub-panels integrally joined along second parallel fold lines traverse to said first fold lines, said first panel section comprising sequentially in the direction from said top to said bottom end, an inner top sub-panel attached to a first upper side sub-panel at one of said second parallel fold lines, a fold line having a slot therein, a first lower side sub-panel attached to said first upper side sub-panel at one of said second parallel fold lines, and a first bottom sub-panel attached to said first lower side sub-panel at one of said second parallel fold lines;

said second panel section comprising sequentially in the direction from said top to said bottom end, a second upper side sub-panel said sub-panel including a first soffit section attached to said first upper side sub-panel at one of said first parallel fold lines, a first central sub-panel attached to said first soffit section at a first perforated fold line and a second soffit section attached to said first central sub-panel at a second perforated fold line, said second panel section further comprising a second lower side sub-panel attached to said first central sub-panel at one of said second parallel fold lines and to said first lower side sub-panel at one of said first parallel fold lines, and a second bottom sub-panel attached to said second lower side sub-panel at one of said second parallel fold lines;

said third panel section comprising sequentially in the direction from said top to said bottom end, a tab means connected to an outer top sub-panel at a fold line, a third upper side sub-panel connected to said outer top sub-panel at one of said second parallel fold lines and to said second soffit section at one of said first parallel fold lines, a third lower side sub-panel connected to said third upper side sub-panel at one of said second parallel fold lines and to said second lower side sub-panel at one of said first parallel fold lines, and a third bottom sub-panel connected to said third lower side sub-panel at one of said second parallel fold lines;

said fourth panel section comprising sequentially in the direction from said top to said bottom end, a fourth upper side sub-panel, said fourth upper side sub-panel including a third soffit section attached to said third upper side sub-panel at one of said first parallel fold lines, a second central sub-panel attached to said third soffit section at a third perforated fold line, and a fourth soffit section attached to said second central sub-panel at a fourth perforated fold line, said fourth panel section further comprising a fourth lower side sub-panel attached to said second central sub-panel at one of said second parallel fold lines and to said third lower side sub-panel at one of said first parallel fold lines and a fourth bottom sub-panel attached to said fourth lower side sub-panel at one of said second parallel fold lines; and said fifth panel section comprising sequentially in the direction from said top to said bottom end a first vertical support panel, a horizontal support panel attached to said first vertical support panel at one of said second parallel fold lines, a glue tab attached to said fourth soffit section at one of said first parallel fold lines, and a second vertical support panel attached to said horizontal support panel at one of said second parallel fold lines and to said fourth lower side sub-section at one of said first parallel fold lines.

16. A paperboard blank according to claim 15, wherein said second bottom sub-panel and said fourth bottom sub-panel each comprise a primary panel section and a glue flap section, said glue flap section being connected to said primary section by a perforated fold line.

17. A paperboard blank according to claim 15, wherein said second central sub-panel includes a window therein, said second lower side sub-panel includes a window therein contiguous with said window in said second central sub-panel and said fourth central sub-panel includes a window therein.

18. A paperboard blank according to claim 16, wherein said second bottom sub-panel and said fourth bottom sub-panel each includes a notch at one end of the perforated fold line between said primary panel section and said glue flap.

* * * * *